US007465188B2

(12) United States Patent
Tan et al.

(10) Patent No.: US 7,465,188 B2
(45) Date of Patent: Dec. 16, 2008

(54) COMPACT PCB CONNECTOR

(75) Inventors: Beng Keat Tan, Perak (MY); Vishva Lakshmanan, Penang (MY); Kai Yong Cheng, Penang (MY)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 11/642,470

(22) Filed: Dec. 19, 2006

(65) Prior Publication Data

US 2008/0146047 A1 Jun. 19, 2008

(51) Int. Cl.
*H01R 13/60* (2006.01)

(52) U.S. Cl. ..... 439/541.5; 439/733.1; 439/608

(58) Field of Classification Search ..... 439/540.1, 439/541.5, 733.1, 608
See application file for complete search history.

(56) References Cited

U.S. PATENT DOCUMENTS 6,749,468 B2 * 6/2004 Avery ..... 439/701
6,827,605 B2 * 12/2004 Wu ..... 439/567

* cited by examiner

*Primary Examiner*—Truc T Nguyen
(74) *Attorney, Agent, or Firm*—Blakely, Sokoloff, Taylor & Zafman LLP

(57) ABSTRACT

A compact PCB connector is disclosed to facilitate connection between various components of computer system. The PCB connector comprises a housing having a front side adjacent to the bottom side of the housing. A plurality of connectors supported by the housing are provided to facilitate connection between the various components of a computer system.

16 Claims, 5 Drawing Sheets

COMPACT PCB CONNECTOR

BACKGROUND OF THE INVENTION

A motherboard is a printed circuit board (PCB) that may serve as a hub for both communication and electrical power in a computer system. The motherboard may be connected to various computer components, such as a microprocessor, storage devices, video cards, and other devices. The motherboard may be connected to these components through a connector, such as an advanced technology attachment (ATA) connector or a peripheral component interconnect (PCI) card.

One of the major issues with such connectors is that the connectors take up too much space on the motherboard. To improve performance, engineers constantly try to improve the utilization of motherboards to support more devices at a higher rate of data transfer. Therefore, space on a motherboard is both limited and precious and should be optimized. When multiple connectors are used, the connectors are typically lined up side by side, occupying too much valuable space on the motherboard.

BRIEF DESCRIPTION OF THE DRAWINGS

The invention described herein is illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements.

DETAILED DESCRIPTION OF THE INVENTION

In the following detailed description, numerous specific details are described in order to provide a thorough understanding of the invention. However the present invention may be practiced without these specific details. In other stances, well known methods, procedures, components and circuits have not been described in detail so as not to obscure the present invention. Further, exemplary sizes, values, and ranges may be given, but it should be understood that the present invention is limited to these specific examples.

References in the specification to "one embodiment", "an embodiment", or "an exemplary embodiment" indicate that the embodiment described may include a particular feature, structure, or characteristic, but not every embodiment necessarily includes the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

A serial advanced technology attachment (SATA) is a standard interface or bus for connecting storage devices to other components in a personal computer through a motherboard. A typical SATA interface includes a data cable or a serial link having seven pins housed in a connector body. Several SATA connectors may be mounted on the motherboard to provide connections between multiple devices and the computer. Though SATA connectors are exemplified in the specific embodiments presented, it will be clear to a person of skilled in the art that the present invention may be applied to a variety of different connectors.

Figure 1:
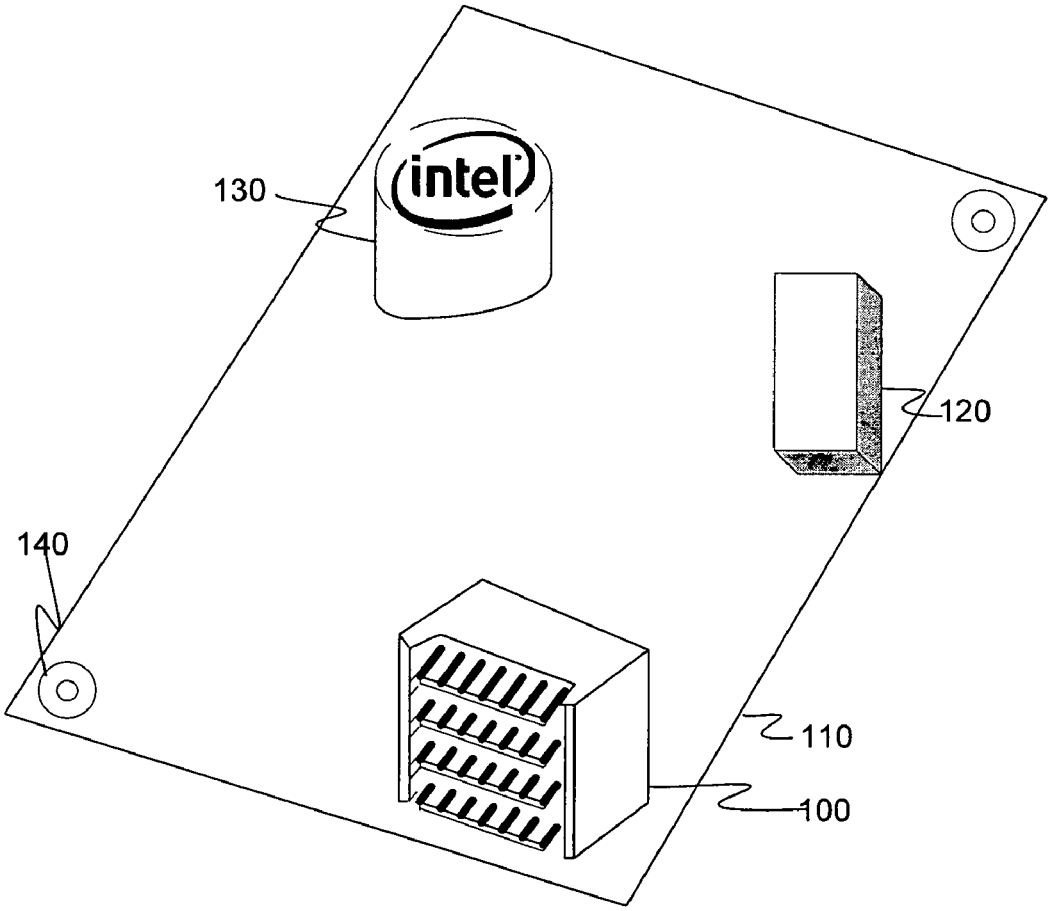
FIG. 1 illustrates a multiple port connector coupled with a mother board.

Referring to FIG. 1, an embodiment of a multiple port connector 100 coupled with a printed circuit board (PCB) 110 is shown. In one embodiment, the multiple port connector (MPC) 100 may be mounted on and coupled to the motherboard 110 of a computer system. The motherboard 110 may be connected to a variety of personal computer components, including peripheral component interconnect (PCI) cards, graphics cards, a hard disc drive interface 120, and a processor 130.

Figure 2:
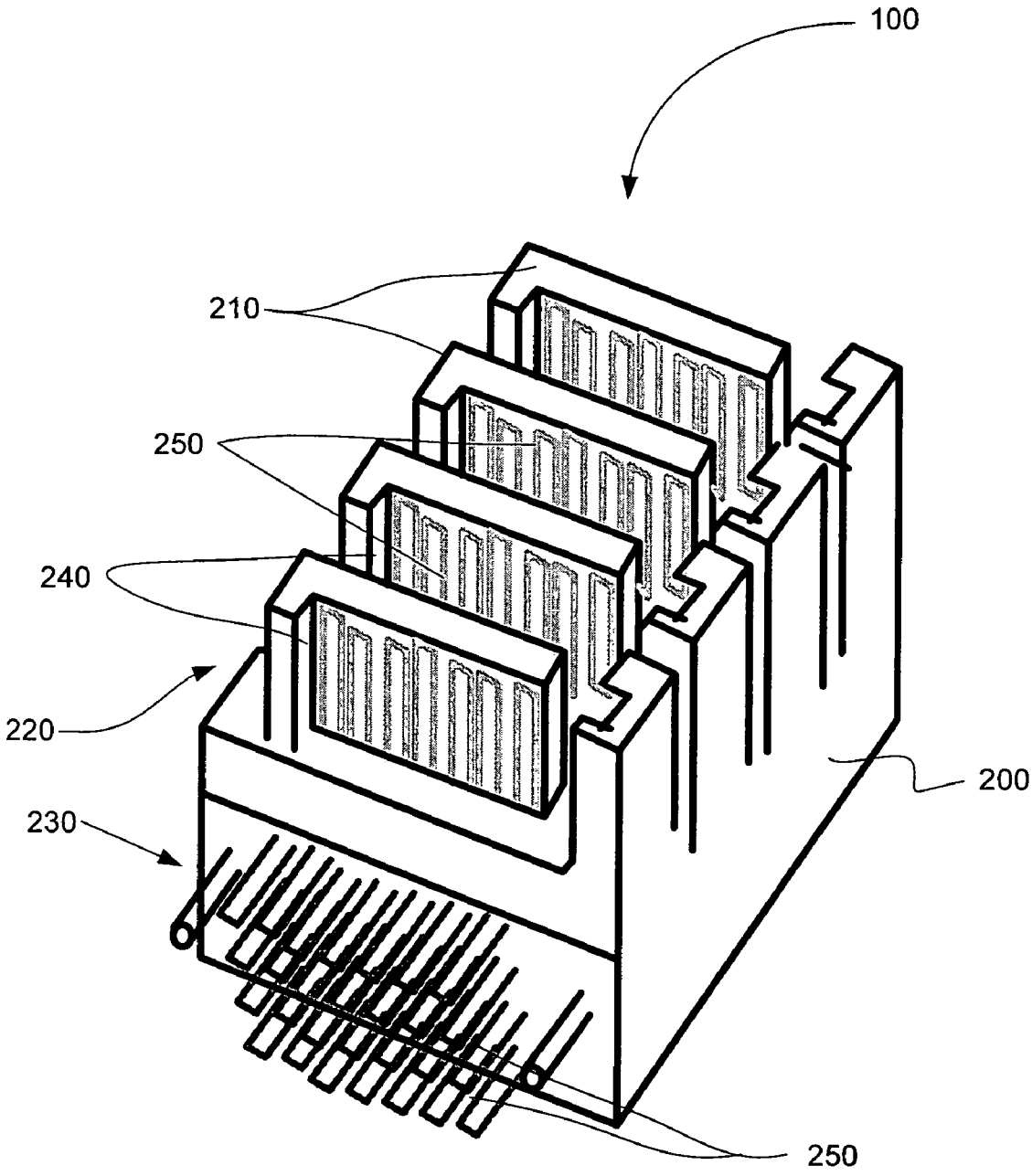
FIG. 2 illustrates perceptive view of the multiple port connector.

Referring now to FIG. 2, an embodiment of the multiple port connector 100 is shown. As depicted, the multiple port connector (MPC) 100 may comprise a housing 200 to support a plurality of connectors 210 therewith. The housing 200 may comprise a front side 220 and a bottom side 230. The front side 220 may be provided adjacent to the bottom side 230 of the housing 200. In one embodiment, the housing 200 and the connectors 210 may be formed from an electromagnetic interference shielding material. In one embodiment, the housing 200 and a plurality of connectors may be formed from a single molding. The plurality of connectors 210 may facilitate connection between various components of the computer system to the motherboard 110. In one embodiment, the connectors 210 may comprise at least two connectors 210.

As depicted, each of the plurality of connectors 210 includes a port 240 and a set of pins 250. In one embodiment the set of pins 250 may be provided at a substantially right angle relative to the port 240. As depicted, the connectors 210 may be stacked on top of each other in the housing 200 to form a single piece multiple port compact PCB connector 100.

The connectors 210 may be provided with the housing 200 to connect various PC components, such as hard disc drives, floppy disc drives and other storage devices with the processor 130 through the motherboard 110. In one embodiment, the connectors may be provided with the housing 200 after manufacturing of the housing 200. The connector 210 may, for example, be a SATA connector.

By stacking the connectors 210, the present invention is able to support multiple ports 240 for other PC components to connect to, while minimizing the space occupied on the motherboard 110. In this manner, the multiple port connector 100 conserves the precious space on the motherboard 110 so that it may either form part of a more compact computer system or free the additional space to support other peripherals.

According to an embodiment, each connector 210 may comprise a port 240, which may be accessed from the front side of the housing 200. A set of pins 250, such as a set of seven pins for a SATA connector, may be coupled with each of the ports 240. The ports 240 may then be accessed from the bottom side 230 of the housing 200 to facilitate coupling of the connector 100 with the motherboard 110.

Figure 3A:
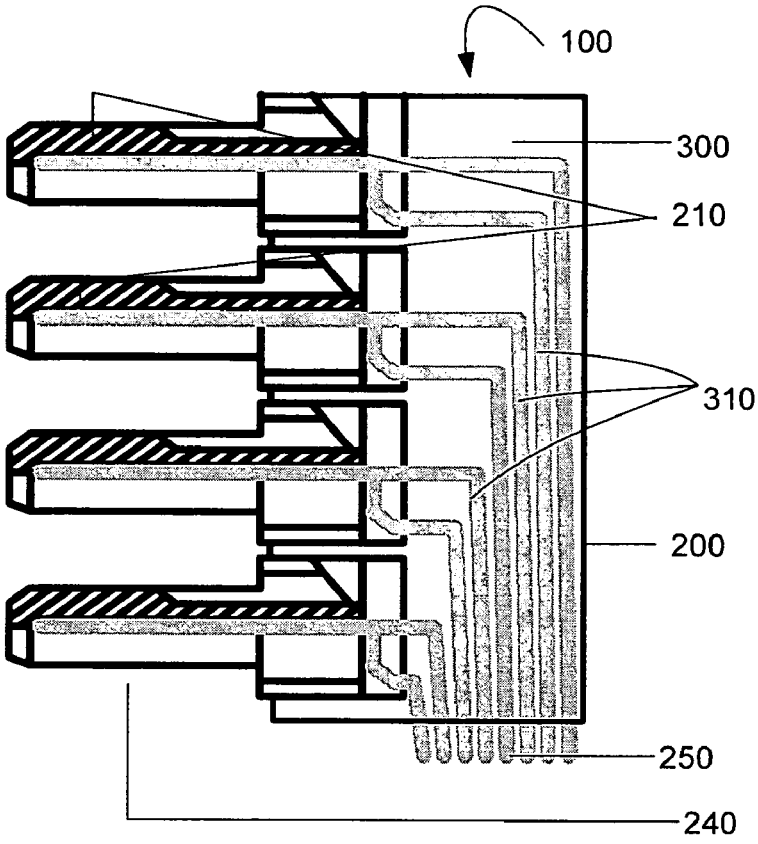
FIGS. 3A-3B illustrate cross sectional views of the multiple port connector.
Figure 3B:
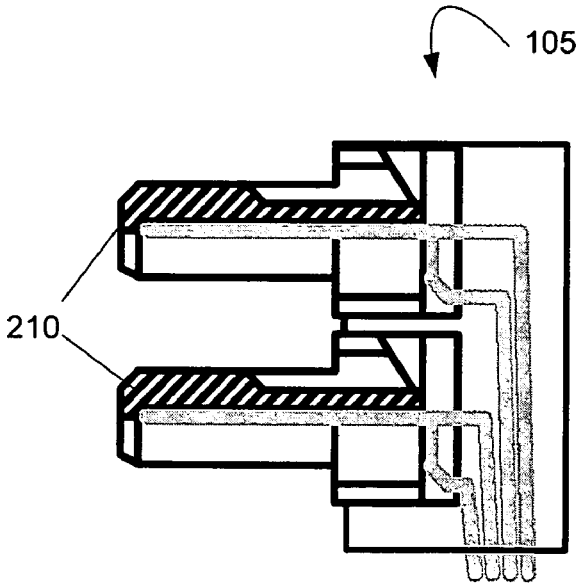

Referring now to FIG. 3, a cross-sectional side view of an embodiment of the multiple port connector 100 is shown. As depicted, the housing 200 may form a channel 300 to accommodate connecting lines 310 of the connectors 210. The connectors 210 may comprise four connectors 210 supported by the housing 200. The ports 240 may be coupled to the pins 250 through the connecting lines 310. In one embodiment, the connecting lines 310 may enable the pins 250 to form a substantially right angle relative to the ports 240 of the MPC 100. In one embodiment and as shown in FIG. 3A, an MPC 105 may comprise at least two connectors 210.

As further shown in FIG. 3, each connecting line 310 has two pins 250 that extend through the bottom side of the housing. The two pins 250, as explained above, attach to the motherboard 110 or other similar device. The connecting line 310 extends from the two pins 250 away from the bottom side 230 toward the respective port 240. The connecting line 310 extends as two separate parts, one for each pin 250, through the housing 200. The parts then join proximate the respective port 240 to form a single contact at the respective port 240 for the connector 210. As explained above, the connector 210 may facilitate connection with various components of the computer system. As further shown in FIG. 3, one part of the connecting line 310, shown in FIG. 3 as the outer part or the part furthest from the port 240, makes a simple right angle turn or bend and then extends into the appropriate port 240. In the example of FIG. 3, this is shown as a bend from a vertical connecting line to a horizontal connecting line. The horizontal part of the line extends into the horizontally oriented port 240. The other part of the connecting line 310, shown as the inner part of the part closest to the port 240, first makes a right angle turn or bend away from the outer part and toward the port 240. It then makes another bend toward the outer part. In the example of FIG. 3, the first bend goes from vertical to horizontal and the second bend is from horizontal to vertical. After the second bend, the inner part vertically to meet with the horizontal section of the outer part of the connecting line 310. The two parts of the line 310 form an open area, space or gap between the two parts of the line 310 between the first right angle bend of the inner part and the one right angle bend of the outer part.

Figure 4:
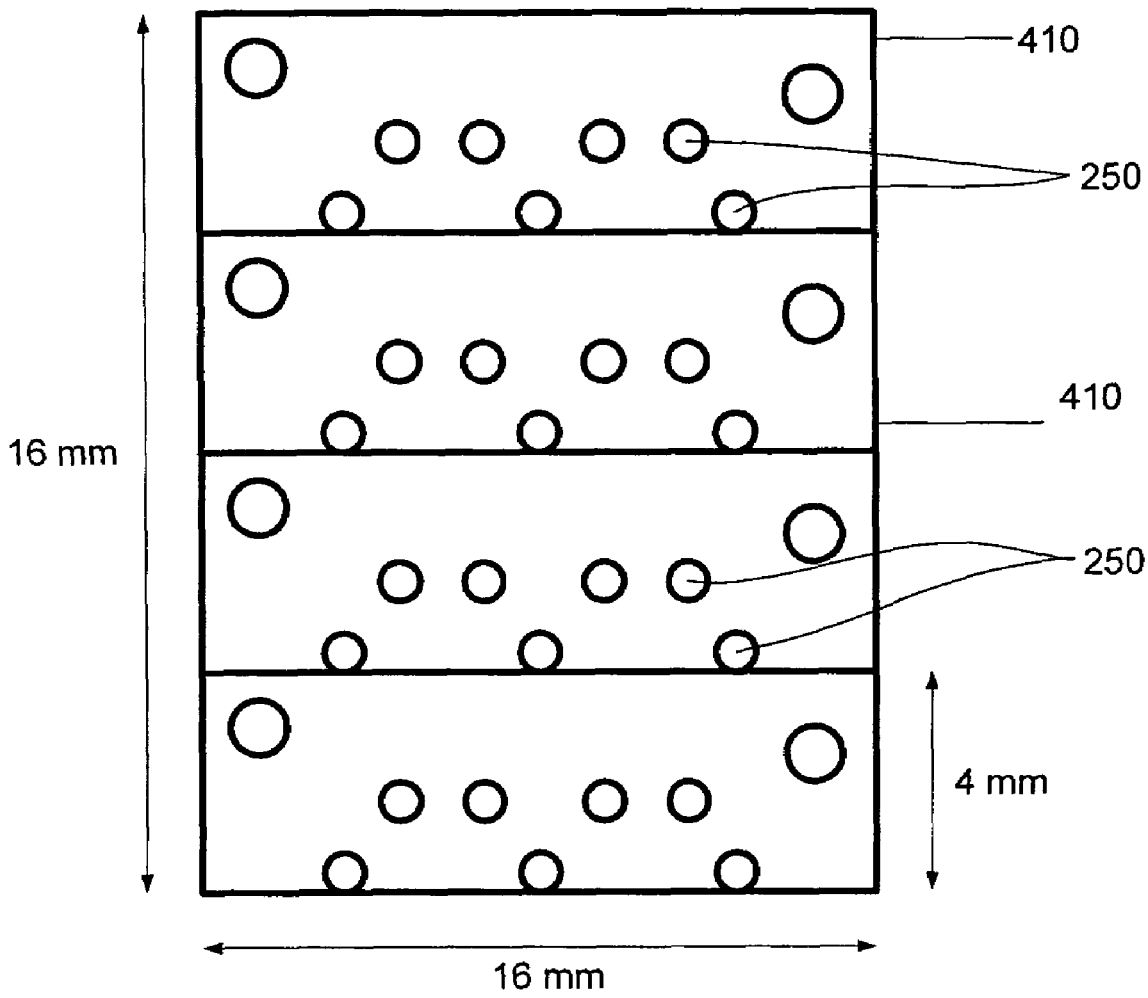
FIG. 4 illustrates bottom view of the connector.

Referring now to FIG. 4, a bottom view of an embodiment of the multiple port connector (MPC) 100 is shown. As depicted, the plurality of pins, such as a set of seven pins 250 of a SATA connector supported by a pin housing 410, may be provided for each of the connectors 210. The set of pins 250 may be accessed from the bottom side 230 of the housing 200 to connect the MPC 100 with the motherboard 110 and facilitate connection between various components of the computer system.

In one embodiment, a plurality of the set of pins, such as four set of pins 250 supported by the respective pin housings 410 may be provided at the bottom side 230 of the housing 200. Each pin housing 410 may comprise a length of about 16 millimeters (mm) and a width of about 4 mm. In one embodiment, the MPC 100 may comprise at least two connectors 210 with corresponding sets of pins 250 and pin housings 410 comprising the bottom side 230 and having the length of about 16 mm and the width of about 8 mm. In another embodiment with four sets of pins 250 and four pin housings 410, the bottom side 230 of the housing 200 may comprise a length of about 16 mm and a width of about 16 mm.

Figure 5:
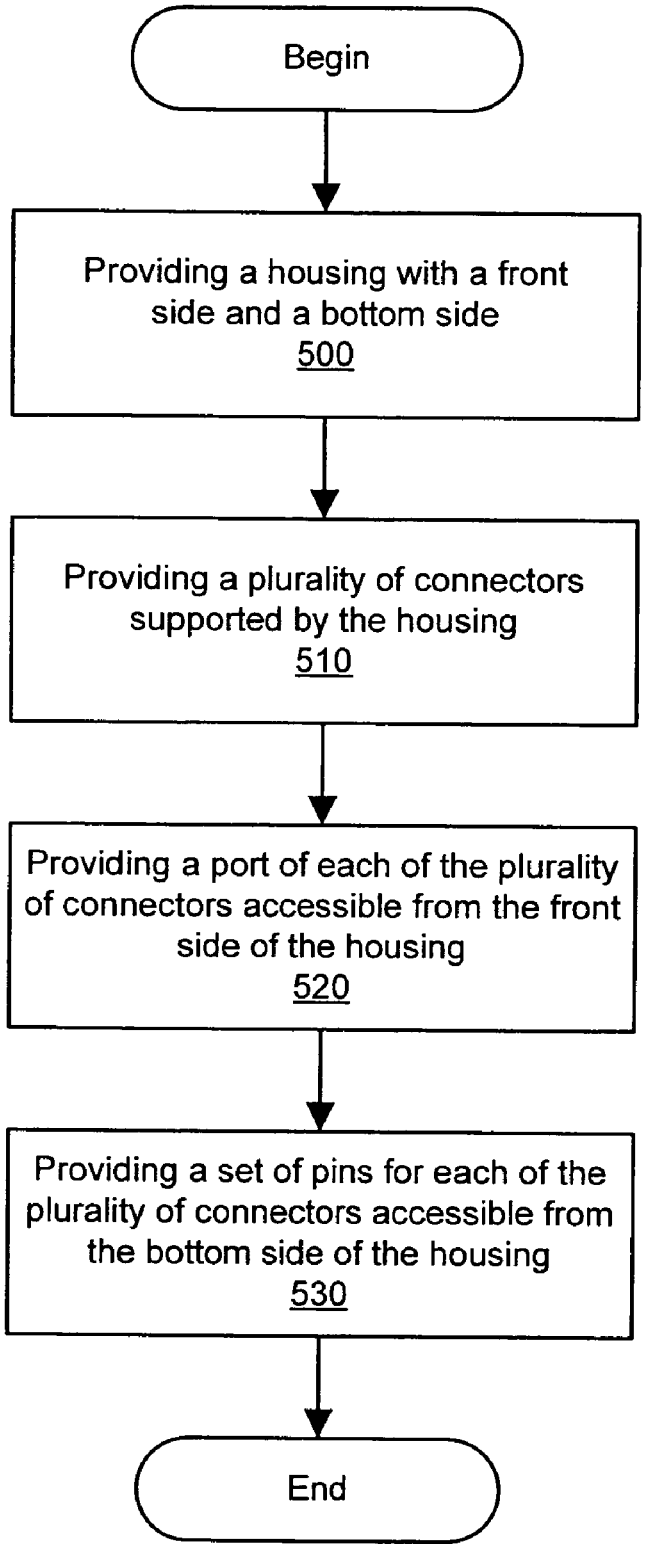
FIG. 5 illustrates a process flow chart followed to provide the multiple port connector.

Reference is now made to FIG. 5, an embodiment of a method to provide a multiple port connector is illustrated. In block 500, a housing having a front side and a bottom side may be provided. In one embodiment, the bottom side may be provided adjacent to the front side.

In block 510, a plurality of connectors may be provided and supported by the housing. The plurality of connectors may facilitate connection between various components of the computer system to the motherboard. The plurality of connectors may be stacked on top of each other. In one embodiment, the plurality of connectors and the housing may be formed from a single molding. In one embodiment, the connectors may comprise at least two connectors.

In block 520, a plurality of ports accessible from the front side of the housing may be provided for each of the connectors. In block 530, a set of pins, such as the seven pins of a SATA connector, may be provided for each of the plurality of ports to be accessed from the bottom side of the housing. Each of the set of pins may be supported by a pin housing 410. Each pin housings may be provided at the bottom side of the housing to reduce the motherboard space used by the multiple port connector (MPC) 100.

The set of pins may be provided to facilitate connection between other components of the computer system to the motherboard. A channel may be formed in the bottom side of the housing to accommodate connecting lines that couple the plurality of pins to the plurality of ports. In one embodiment, the connecting lines may be configured so that the pins may be provided at a substantially right angle relative to the ports.

Certain features of the invention have been described with reference to example embodiments. However, the description is not intended to be construed in a limiting sense. Various modifications of the example embodiments, as well as other embodiments of the invention, which are apparent to persons skilled in the art to which the invention pertains are deemed to lie within the spirit and scope of the invention.

What is claimed is:

1. A multiple port connector, comprising:

a housing having a front side and bottom side, wherein the front side is adjacent to the bottom side; and a plurality of connectors supported by the housing, wherein each of the plurality of connectors comprises:

a port accessible from the front side of the housing;

a set of pins coupled to the port, wherein the set of pins is accessible from the bottom side of the housing; and a connecting line between each port and the set of pins, each connecting line having two parts extending each from a single pin and then joining together proximate the port, the two parts forming a space between them proximate the port.

2. The multiple port connector of claim 1, wherein each of the plurality of connectors is a serial advanced technology attachment connector.

3. The multiple port of connector of claim 2, wherein the set of pins are to connect to a serial advanced technology attachment connector port of a motherboard.

4. The multiple port connector of claim 1, wherein the set of pins is coupled to the port through a set of connecting lines to form a substantially right angle relative to the port.

5. The multiple port connector of claim 2, wherein the plurality of connectors comprises four connectors supported by the housing and wherein the bottom of the housing has a length of about 16 millimeters and a width of about 16 millimeters.

6. The multiple port connector of claim 2, wherein a plurality of connectors comprises at least two connectors supported by the housing and wherein bottom of the housing has a length of about 16 millimeters and a width of about 8 millimeters.

7. The method of claim 1, wherein the housing comprises an electromagnetic interference shielding material.

8. The multiple port connector of claim 7, wherein the housing and the plurality of connectors are formed from a single molding.

9. A method providing a multiple port connector, comprising:

providing a housing having a front side and a bottom side, wherein the front side is adjacent to the bottom side;

providing a plurality of connectors, accessible from the front side of the housing;

providing a set of pins for each of the plurality of connectors accessible from the bottom side of the housing; and providing a connecting line between each port and the set of pins, each connecting line having two parts extending each from a single pin and then joining together proximate the port, the two parts forming a space between them proximate the port.

10. The method of claim 9, wherein the housing and the plurality of connectors are formed from a single molding.

11. The method of claim 10, wherein the plurality of connectors comprise four connectors and wherein the bottom of the housing has a length of about 16 millimeters and a width of about 16 millimeters.

12. The method of claim 10, wherein the plurality of connectors comprise at least two connectors and wherein the bottom of the housing has a length of about 16 millimeters and a width of about 8 millimeters.

13. The method of claim 9, wherein the plurality of connectors are serial advanced technology attachment connectors.

14. The method of claim 13, wherein the set of pins is to couple with a serial advanced technology attachment connector port of a motherboard.

15. The method of claim 9, wherein the set of pins is coupled to the port through a set of connecting lines to form a substantially right angle relative to the port.

16. The method of claim 10, wherein the housing and the plurality of connectors are formed from an electromagnetic interference shielding material.

* * * * *